United States Patent [19]

Godfrey

[11] Patent Number: 4,996,920

[45] Date of Patent: Mar. 5, 1991

[54] TIRE BALER

[76] Inventor: Dale Godfrey, P.O. #2, Cannington, Ontario, L0E 1E0, Canada

[21] Appl. No.: 516,518

[22] Filed: Apr. 30, 1990

[51] Int. Cl.[5] ..... B30B 5/00

[52] U.S. Cl. ..... 100/242; 100/12; 100/232; 100/255; 100/265; 100/295

[58] Field of Search ..... 100/12, 232, 242, 252, 100/255, 265, 266, 295

[56] References Cited

U.S. PATENT DOCUMENTS

| | | | |
|---|---|---|---|
| 1,047,809 | 12/1912 | Hoffman | 100/252 X |
| 1,476,532 | 12/1923 | MacIlwaine | 100/255 X |
| 2,207,032 | 7/1940 | Steinhauer | 100/255 |
| 3,020,831 | 2/1962 | Barnes | 100/232 |
| 3,195,820 | 7/1965 | Halacsy | 100/12 X |
| 3,687,068 | 8/1972 | Loughran | 100/255 |
| 3,768,399 | 10/1973 | Martiniak | 100/255 X |
| 3,853,052 | 12/1974 | Engebretsen | 100/252 X |
| 3,955,491 | 5/1976 | McMahon | 100/12 X |
| 4,006,678 | 2/1977 | Laurie et al. | 100/3 X |
| 4,095,560 | 6/1978 | Laurie et al. | 100/12 X |
| 4,222,323 | 9/1980 | Martindale | 100/12 |

*Primary Examiner*—Harvey C. Hornsby
*Assistant Examiner*—Stephen F. Gerrity
*Attorney, Agent, or Firm*—Fetherstonhaugh & Co.

[57] ABSTRACT

A tire baler for baling tires having tire alignment walls located about the perimeter of the tire baling compartment which can be displaced radially outwardly to accommodate radial expansion of the stack of tires when the tires are compressed to form a bale. Pressure pads are adjustably mounted on the compression head so as to be movable radially with respect to the compression axis to maintain compression contact with tires of different diameters.

6 Claims, 3 Drawing Sheets

TIRE BALER

BACKGROUND OF THE INVENTION

The difficulties associated with the disposal of used tires are well known. Tires have a large bulk in relation to their mass and for this reason they occupy a very large bulk when they are being transported to a disposal site.

U.S. Pat. No. 3,955,491 to McMahon, dated May 11, 1976, discloses an automobile tire stacking and strapping machine which is designed to be used in a tire manufacturing plant. It is a highly sophisticated and complex piece of machinery which includes a lift cylinder mechanism which operates to permit tires to be added to the bottom of the stack of tires in order to accumulate the stack. After the last tire has been introduced into the stack at the bottom thereof, the entire tire clamping carriage is caused to shift bodily rearwardly toward the strapping station. The mechanism required for this purpose is complex and expensive and, as a result, this equipment is only suitable for use in a tire manufacturing plant.

There are a substantial number of installations where a tire baler can be used to advantage in the disposal of used tires. For example, there is a need for an inexpensive tire baler which can easily be transported to a retail outlet which sells new tires which is required to store used tires for shipment to a tire disposal site. The mechanism of U.S. Pat. No. 3,955,491 is so complex as to be unsuitable for this type of tire disposal operation.

A further machine for compressing, slitting and baling stacks of tires is disclosed in U.S. Pat. No. 4,006,687. In order to maintain tire alignment in this mechanism, a centering spool is used to centre the tire and a guy rod extends upwardly through the centre openings of the tires to maintain vertical alignment of the stack. The guy rod and centering spool are substantially smaller than the wheel opening in the tires, and consequently they do not offer a good support for alignment purposes.

U.S. Pat. No. 4,095,560 Laurie et al. also discloses a baler for baling used tires. However, again, this structure does not overcome the difficulty of maintaining alignment in the tires during the tire stacking operation.

I have found that I can provide an inexpensive tire baler which has a simple and efficient tire alignment mechanism for maintaining the tires in alignment during the initial stacking of the tires within the tire compression chamber.

It is therefore an object of the present invention to provide a simple and inexpensive tire baler which has a simple and inexpensive mechanism which serves to maintain alignment of the tires during the initial stacking of the tires in the tire compression chamber.

It is a further object of the present invention to provide a tire baler in which the tire alignment mechanism is in the form of tire alignment walls yieldably mounted in a tire alignment chamber so as to be movable between an inner position supporting the uncompressed stack of tires in alignment and an outer position which permits the tires to expand radially outwardly during compression.

SUMMARY OF INVENTION

According to one aspect of the present invention there is provided a tire baler for baling tires which are stacked one on top of another in a sidewall-to-sidewall relationship with the tread portion of each tire facing radially outwardly of the stack which comprises, a frame having a compression chamber therein which has an upper end, a lower end, a pair of oppositely disposed sides, a front end, a back end and a compression axis which extends vertically within said compression chamber, compression means mounted on the frame for movement between a raised position located above the compression chamber and a lowered position located within the compression chamber, tire alignment walls located at circumferentially spaced intervals about said compression axis and defining the perimeter of an alignment compartment within said compression chamber which has a diameter only slightly larger than that of the tires before compression therein, said tire alignment walls cooperating with one another to retain a stack of tires therein with the axes of rotation of the tires substantially aligned with the vertical axis, said tire alignment walls being mounted on said frame for movement to and fro between an inner position and an outer position with respect to said vertical axis, said walls being free to move toward the outer position during compression of the tires to permit radial expansion of the tires as they are compressed, and means for returning the tire aligning walls to the inner position upon removal of a baled stack of compressed tires from the compression chamber.

BRIEF DESCRIPTION OF THE DRAWINGS

The invention will be more clearly understood after reference to the following detailed specification read in conjunction with the drawings, wherein.

DESCRIPTION OF PREFERRED EMBODIMENT

Figure 1:
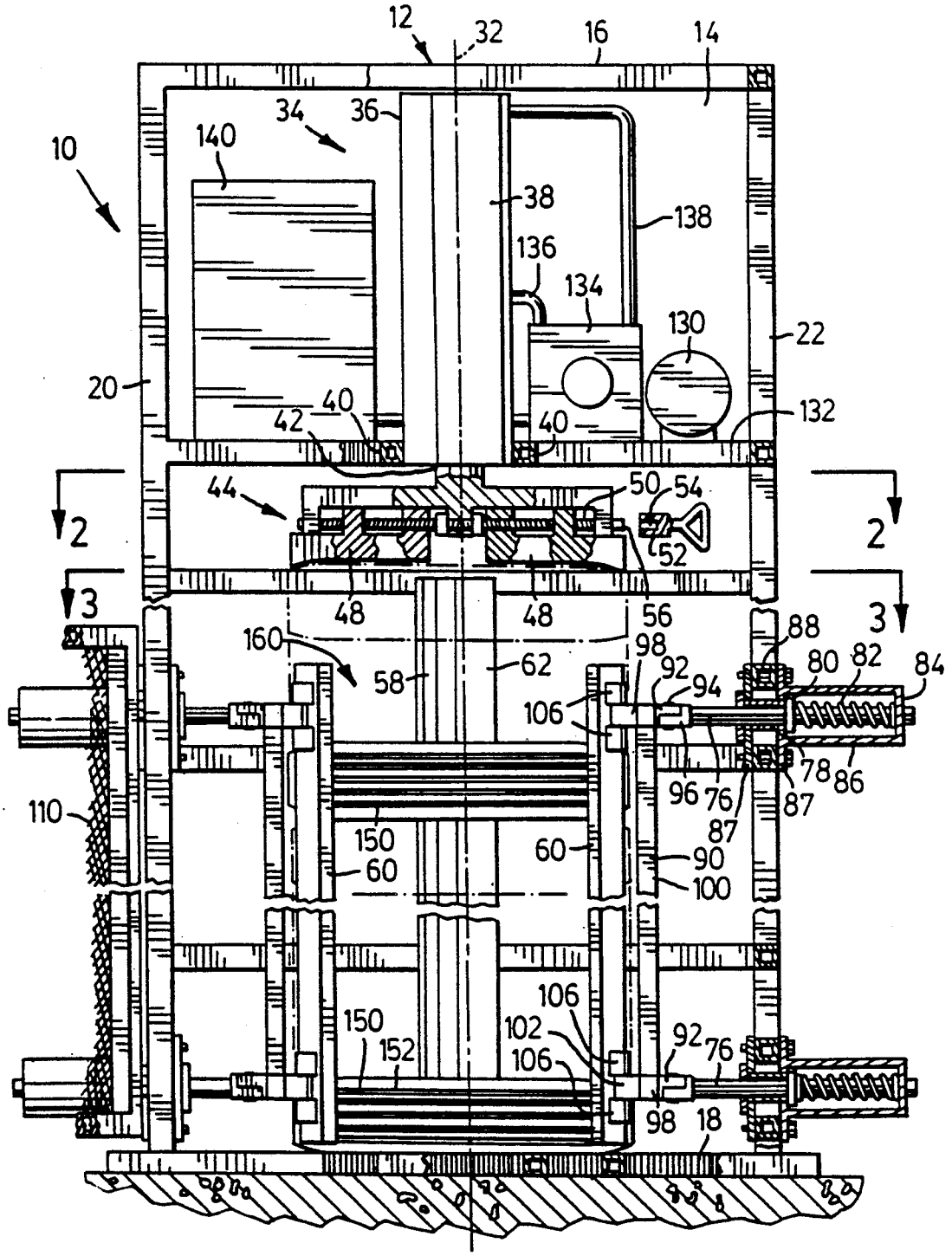
FIG. 1 is a partially sectioned front view of a tire baler constructed in accordance with an embodiment of the present invention.

With reference to FIG. 1 of the drawings, the reference numeral 10 refers generally to a tire baler constructed in accordance with an embodiment of the present invention. The tire baler 10 comprises a frame 12 which has a compression chamber 14 located therein. The frame 12 has an upper end 16 and a lower end 18, oppositely disposed sides 20 and 22, a front end 24 (FIG. 2) and a back end 26. The frame has four vertically extending corner posts 28 and a plurality of horizontally extending frame members 30 which extend between the posts 28. A compression axis 32 extends vertically through the compression chamber.

The compression mechanism is generally identified by the reference numeral 34. The compression mechanism comprises an extensible ram assembly 36 which has a cylinder 38 mounted on horizontal support bars 40, a ram 42 is mounted in the cylinder 38 and projects downwardly therefrom. A compression head generally identified by the reference numeral 44 is located at the lower end of the ram. The compression head 44 comprises a support bar 46, a pair of pressure pads 48 and an adjustment screw 50. The pads 48 are slidably mounted on the support bar 46 and threadedly mounted on the adjustment screw 50 such that rotation of the adjustment screw 50 in one direction will cause the pads to move outwardly from the compression axis 32 and rotation in the other direction will cause the pads to move inwardly toward the compression axis 32. An adjustment handle 52 is provided which has a socket 54 therein which serves to accommodate a square-shaped end portion 56 of the adjustment screw 50.

Tire alignment wall 58 is mounted on the back end of the frame 12 and a pair of oppositely disposed tire alignment walls 60 are mounted on the sides of the frame.

Figure 2:
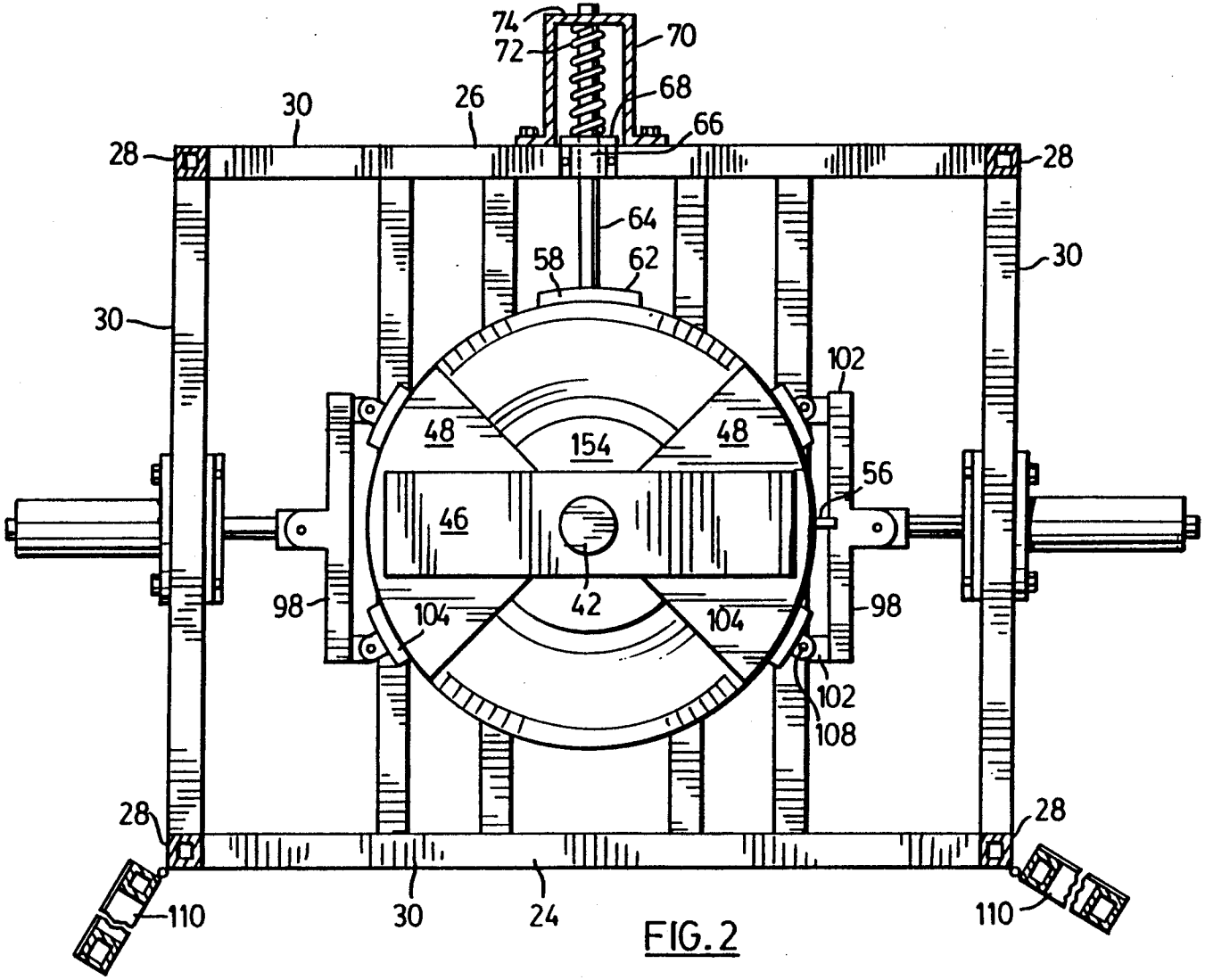
FIG. 2 is a sectional plan view taken along line 2—2 of FIG. 1.

As shown in FIG. 2 of the drawings, the tire alignment wall 58 comprises an arcuate-shaped wall member 62 which has shafts 64 (only one of which is shown) projecting rearwardly therefrom. The shafts 64 are slidably mounted in bearings 66 supported by the transverse members 30. A collar 68 is mounted on the shaft 62 in a fixed position. Housing 70 is mounted on the transverse members 30 and projects rearwardly therefrom. A compression spring 72 is mounted in the housing 70 and has one end bearing against the outer end 74 of the housing and its other end bearing against the collar 68. As a result of this structure, the tire alignment wall 58 can be displaced outwardly from its innermost setting which is shown in FIG. 2. As the wall member 62 is displaced outwardly the spring 72 will be compressed between the collar 68 and the end wall 74. When the force which drives the side wall member 62 outwardly is removed, the compression spring will drive the collar 64 to its normal position shown in FIG. 2, and consequently the tire alignment wall is normally urged to its innermost position which is shown in FIG. 2.

The tire alignment walls 60 are mounted in a frame in a manner similar to that described with reference to the tire alignment walls 58, in that they have a shaft 76 slidably mounted in a bearing 78. A collar 80 is mounted on the shaft 76 and a compression spring 82 extends between the collar 80 and the end wall 84 of the housing 86. The bearing 78 is supported in support plates 87 which are mounted on transverse beams 88. A frame 90 has lugs 92 which are pivotally mounted by means of pivot pins 94 on the end plate 96 which is mounted at the inner end of each shaft 76. The frame 90 has transverse members 98 at the upper and lower end thereof and a vertical member 100. Lugs 102 project forwardly from the opposite ends of the transverse members 98. Arcuate shaped wall members 104 have lugs 106 projecting rearwardly therefrom. A pivot pin 108 serves to pivotally connect the lugs 106 and 102 to permit the arcuate shaped wall members 104 to self align with respect to the outer perimeter of the tires, as will be described hereafter.

Gates 110 are hingedly mounted on the corner posts 28 located at the front end of the frame for movement between an open position shown in FIG. 2 and a closed position in which they extend transversely across the open front end and serve to prevent direct access to the compression chamber.

Figure 3:
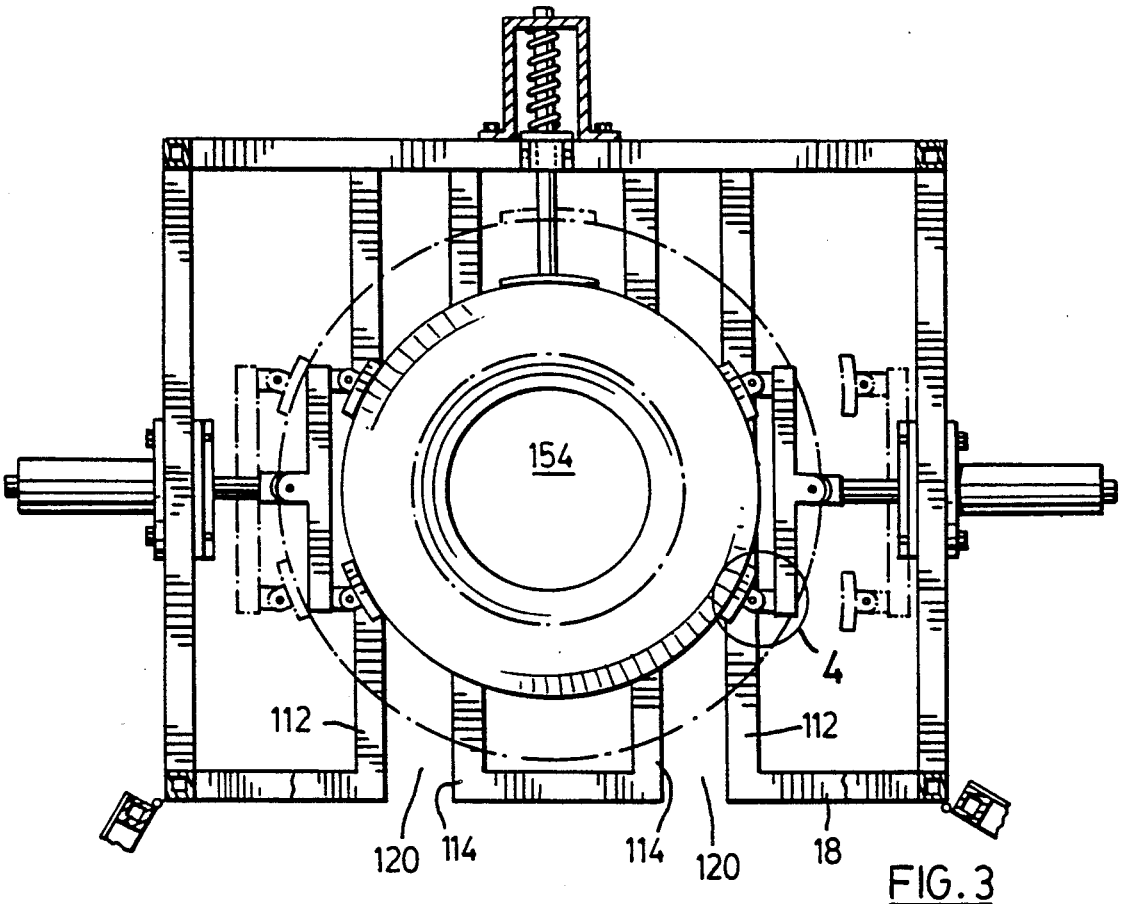
FIG. 3 is a sectional plan view taken along line 3—3 of FIG. 1.

As shown in FIG. 3 of the drawings, the bottom end 18 of the frame is formed with frame members 112 and 114 which extend from the front end to the back end and serve to provide guideways 120 which provide access for the forks of a forklift truck which will permit the forks to pass under the compression compartment during the removal of tires therefrom.

To drive the ram 48 an electric motor 130 (FIG. 1) is provided, which is mounted on transverse support members 132 of the frame. The motor 130 serves to drive a pump 134 which is connected through conduits 136 and 138 to the double acting cylinder 38. An hydraulic fluid reservoir 140 is also provided. The pump 134 draws fluid from the reservoir 140 and delivers it to the hydraulic cylinder to cause the ram 42 to be extended or retracted as required in use. This type of mechanism is well known and will not therefore be described in detail.

Figure 5:
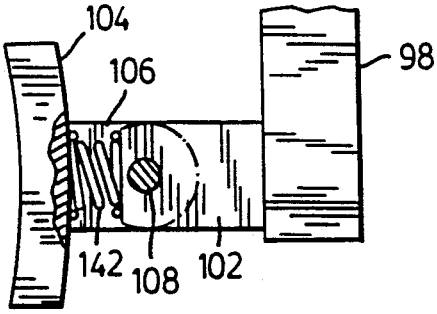
FIG. 5 is a view similar to FIG. 4 showing the adjustable side wall pressure pads in the second position.
Figure 4:
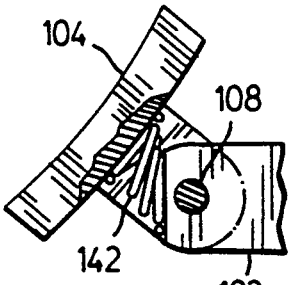
FIG. 4 is a partially sectioned enlarged detail of the encircled portion 4 of FIG. 3.

FIGS. 4 and 5 of the drawings illustrate a mechanism which may be used in order to make the arcuate shaped wall members 104 return to a set position when the stack of tires is removed from the compression compartment. In this construction a compression spring 142 is located between the inner end of the lug 102 and the back face of the wall 104. This spring 142 will be deflected as shown in FIG. 4 when the wall 104 pivots in order to comply with the curvature of the tires.

The tire baler of the present invention can be used for the purposes of baling used tires which are either complete or which have been pre-split.

In use, the gates 110 are initially open to provide access to the compression chamber. A first tire 150 is located in the compression compartment as shown in FIG. 1, so that it rests upon the bottom end 18 of the frame and it will be centred with respect to the axis 32 by contact with the tire alignment walls 58 and 60. It will be understood that the original position of the tire alignment walls 58 and 60 is predetermined depending upon the diameter of the tires which are to be compacted. The position of the various tire alignment walls can be adjusted merely by altering the position of the collar 80 with respect to the shaft 76.

After the first tire has been inserted, successive tires are loaded through the open upper end of the compression compartment. The compression compartment is generally identified by the reference numeral 160 and has its perimeter defined by the inner edges of the tire alignment walls 58 and 60. It will be noted that the tire alignment wall 58 projects above the upper ends of the tire alignment walls 60. This permits the tire alignment wall 58 to act as a backstop during the tire loading operation. Tires are positioned one at a time into the space provided above the walls 60 and are then simply dropped into the open upper end of the compression compartment. The tires will fall under their own weight to form a stack of tires in the compression compartment 150. When the compression compartment 150 is full, a stack of tires will be located therein in a sidewall-to-sidewall relationship with the tread portion 152 thereof facing radially outwardly of the stack. The position of the pressure pads 48 of the compression head 44 may then be adjusted by means of the adjustment handle 52 is required, to ensure that the pressure pads will bear against the side wall of the uppermost tire in the stack when the head is lowered. The pressure pads 48 should not be adjusted so that they extend beyond the outer perimeter of the uncompressed upper tire to ensure that they will pass freely down into the compression chamber when the head is lowered.

The controls of the pump 134 (not shown) are then manipulated to cause the ram 42 to extend downwardly from the cylinder 38, thus driving the pressure pads 48 into contact with the uppermost tire. Continued downward movement of the compression head compresses the stack of tires. Because the side walls of the tires are compressed toward one another, the tread portion of the tires will be urged radially outwardly. This radial expansion of the tires during compression is accommodated by the tire alignment walls because, as previously described, these walls are free to move away from the compression access 32. The tire alignment walls serve to provide external tire alignment surfaces which maintain the tires in alignment during the initial forming of the tires into the stack without preventing the natural radial expansion of the tires during their compression.

When the stack of tires is fully compressed, baling wire may then be threaded through the hollow core 154 of the stack of tires and bound around the stack in order to maintain the stack in the compact configuration. The strapping of the tires in order to form a bale may be carried out either manually or by means of a mechanical strapping mechanism.

From the foregoing, it will be apparent that the present invention provides a simple and inexpensive form of tire baling mechanism which makes provision for the alignment of the tires during the initial forming of the stack of tires by means of tire alignment walls applied externally to the stack which are yieldable under the influence of the compressor fluids applied to the stack in order to be outwardly deflected as the tires expand radially outwardly during compression. The mechanism of the present invention may easily be transported from one site to another and it is anticipated that this mechanism may be used by or transported to retail outlets.

Various modifications of the present invention will be apparent to those skilled in the art. It will be apparent that the compression spring mechanism which is used to permit the tire alignment walls to be deflected radially outwardly could be replaced by hydraulic mechanisms controlled through suitable hydraulic circuits which would permit the hydraulic pressure applied to the system to be relieved when pressure is applied to the stack of tires, so that the tire alignment walls may be free to move outwardly in response to the radial expansion of the stack of tires. These and other modifications of the present invention will be apparent to those skilled in the art.

The embodiments of the invention in which an exclusive property pr privilege is claimed are define as follows:

1. A tire baler for baling tires which are stacked one on top of another in a sidewall-to-sidewall relationship with the tread portion of each tire facing radially outwardly of the stack comprising;

(a) a frame having a compression chamber therein which has an upper end, a lower end, a pair of oppositely disposed sides, a front end, a back end and a compression axis which extends vertically within said compression chamber, (b) compression means mounted on the frame for movement between a raised position located above the compression chamber and a lowered position located within the compression chamber, (c) tire alignment walls located at circumferentially spaced intervals about said compression axis and defining the perimeter of an alignment compartment within said compression chamber which has a diameter only slightly larger than that of the tires before compression therein, said tire alignment walls cooperating with one another to retain a stack of tires therein with the axes of rotation of the tires substantially aligned with the vertical axis, said tire alignment walls being mounted on said frame for movement to and fro between an inner position and an outer position with respect to said compression axis, said walls being free to move toward the outer position during compression of the tires to permit radial expansion of the tires as they are compressed, and means for returning the tire aligning walls to the inner position upon removal of a baled stack of compressed tires from the compression chamber.

2. A tire baler as claimed in claim 1 wherein said compression means has a head on which two pressure pads are mounted for radial movement with respect to said compression axis so as to be adjustable to bear against tires of different diameter during compression.

3. A tire baler as claimed in claim 1 further comprising a gate mounted at the front of the frame for movement between an open position in which it will permit tires to pass through the front end of the frame into the compression chamber for stacking in the alignment compartment and a closed position in which the gate prevents access to the compression chamber.

4. A tire baler as claimed in claim 1 wherein the tire alignment walls are normally urged radially inwardly toward said inner position.

5. A tire baler as claimed in claim 1 further comprising spring means arranged to urge the tire alignment walls towards said inner position.

6. A tire baler as claimed in claim 1 wherein said tire alignment walls comprise first and second side wall members slidably mounted on said first and second sides of said frame respectively and a back wall member slidably mounted on the back of the frame.

* * * * *